US009651898B2

(12) United States Patent
Hatano

(10) Patent No.: US 9,651,898 B2
(45) Date of Patent: May 16, 2017

(54) BELT MODULE AND BELT MEMBER EXCHANGING METHOD

(71) Applicant: CANON KABUSHIKI KAISHA, Tokyo (JP)

(72) Inventor: Fukashi Hatano, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/991,378

(22) Filed: Jan. 8, 2016

(65) Prior Publication Data

US 2016/0202640 A1 Jul. 14, 2016

(30) Foreign Application Priority Data

Jan. 9, 2015 (JP) ..... 2015-003338

(51) Int. Cl.
*G03G 15/16* (2006.01)
*G03G 21/16* (2006.01)

(52) U.S. Cl.
CPC ..... *G03G 15/1605* (2013.01); *G03G 15/162* (2013.01); *G03G 21/168* (2013.01)

(58) Field of Classification Search
CPC . G03G 15/1605; G03G 15/162; G03G 15/754
USPC ..... 399/116, 121, 162
See application file for complete search history.

(56) References Cited

U.S. PATENT DOCUMENTS 4,811,839 A * 3/1989 Cornell et al. ..... G03G 15/754 206/303
5,506,707 A 4/1996 Segawa
5,708,924 A * 1/1998 Shogren et al. ..... G03G 15/754 399/116
6,049,682 A * 4/2000 Goetzke et al. ..... G03G 15/754 399/162
6,175,704 B1 * 1/2001 Yamamoto ..... G03G 15/754 399/162
6,640,068 B2 * 10/2003 Wagner et al. ..... G03G 15/754 399/116
7,295,794 B2 * 11/2007 Asaoka et al. ..... G03G 15/754 399/116
7,793,777 B2 * 9/2010 Parks ..... G03G 21/1623 399/121

FOREIGN PATENT DOCUMENTS

JP 7-43735 A 2/1995
JP 11-352837 A 12/1999
JP 2002-296922 A 10/2002
JP 2004-29309 A 1/2004
JP 2004-109267 A 4/2004

* cited by examiner

*Primary Examiner* — William J Royer
(74) *Attorney, Agent, or Firm* — Fitzpatrick, Cella, Harper & Scinto

(57) ABSTRACT

A belt module including a replacement belt member to be supported by a supporting portion of an image forming apparatus includes an endless belt member, and a protecting sheet, provided along an inner peripheral surface of the belt member, for suppressing deformation of the belt member by an external force and for protecting the inner peripheral surface of the belt member.

18 Claims, 10 Drawing Sheets

BELT MODULE AND BELT MEMBER EXCHANGING METHOD

FIELD OF THE INVENTION AND RELATED ART

The present invention relates to a belt module, for exchanging an endless belt member, used in an image forming apparatus, such as a copying machine, a printer or a facsimile machine, using an electrophotographic type or an electrostatic recording type.

Conventionally, for example, in the image forming apparatus of the electrophotographic type, the endless belt member has been used as a photosensitive (member) belt, a transfer material feeding belt, an intermediary transfer belt or the like. Such a belt member is periodically exchanged in some cases since breakage generates due to a change with time or fatigue caused by driving of the belt member for a long time.

As an exchanging method of such a belt member, as described in Japanese Laid-Open Patent Application (JP-A) 2004-109267, a frame for a supporting unit for supporting rollers for stretching the belt member is configured so that the frame can be folded in two (half). Then, the frame is folded in two, and a projected area defined by an outer edge line of the supporting unit is made smaller than a projected area defined by an outer periphery of the belt member when viewed from a side surface side, and thereafter the belt member is demounted in a widthwise direction thereof and a new belt member is mounted in the widthwise direction to replace the belt member with the new belt member. In JP A 2002 296922, a supporting unit is constituted by a pair of frames capable of being separated from each other. Then, by demounting screws, the pair of frames are separated from each other, and after the rollers are disconnected, a belt member used is demounted in a widthwise direction and a new belt member is mounted in the widthwise direction to replace the belt member with the new belt member.

However, as in the above-described conventional methods, even when the belt member can be inserted in the widthwise direction thereof by folding or the like the frame, it is difficult to insert the belt member so that end portions of the belt member do not contact the frame during the insertion of the belt member.

In recent years, a thickness of the belt member has become thin, and in some cases, the belt member thickness is 48 μm, for example. It is difficult to handle such a belt member having a relatively thin thickness, and during the insertion of the belt member relative to the frame, only by contact of an end portion of the belt member with the frame, a dent is made in some cases. In addition, when a single belt member is taken out from a packing box, the dent and a fold are made in some cases only by being somewhat twisted.

As described above, damage to the belt member by the dent, the fold or the like causes a phenomenon that an image on which a trace of the damaged portion appears or a phenomenon that the damaged portion is a starting point of improper cleaning or breakage of the belt member, and therefore the belt member cannot be used in some cases.

SUMMARY OF THE INVENTION

According to an aspect of the present invention, there is provided a belt module including a replacement belt member to be supported by a supporting portion of an image forming apparatus, the belt module comprising: an endless belt member; and a protecting sheet, provided along an inner peripheral surface of the belt member, for suppressing deformation of the belt member by an external force and for protecting the inner peripheral surface of the belt member.

According to another aspect of the present invention, there is provided a belt member exchanging method using a belt module including a replacement endless belt member to be supported by a supporting portion of an image forming apparatus, and a protecting sheet, provided along an inner peripheral surface of the belt member, for suppressing deformation of the belt member by an external force and for protecting the inner peripheral surface of the belt member, the belt member exchanging method comprising: (a) a step of demounting the belt member from the supporting portion; (b) a step of providing the belt module at the supporting portion in a position surrounding the supporting portion; and (c) a step of pulling-out the protecting sheet from an inner peripheral surface portion of the belt member by moving the protecting sheet from the belt module in a widthwise direction of the belt member in a state in which the belt member is provided in the position surrounding the supporting portion.

Further features of the present invention will become apparent from the following description of exemplary embodiments with reference to the attached drawings.

DESCRIPTION OF THE EMBODIMENTS

A belt module and a belt member exchanging method according to the present invention will be described with reference to the drawings.

Embodiment 1

1. General Constitution and Operation of Image Forming Apparatus

Figure 1:
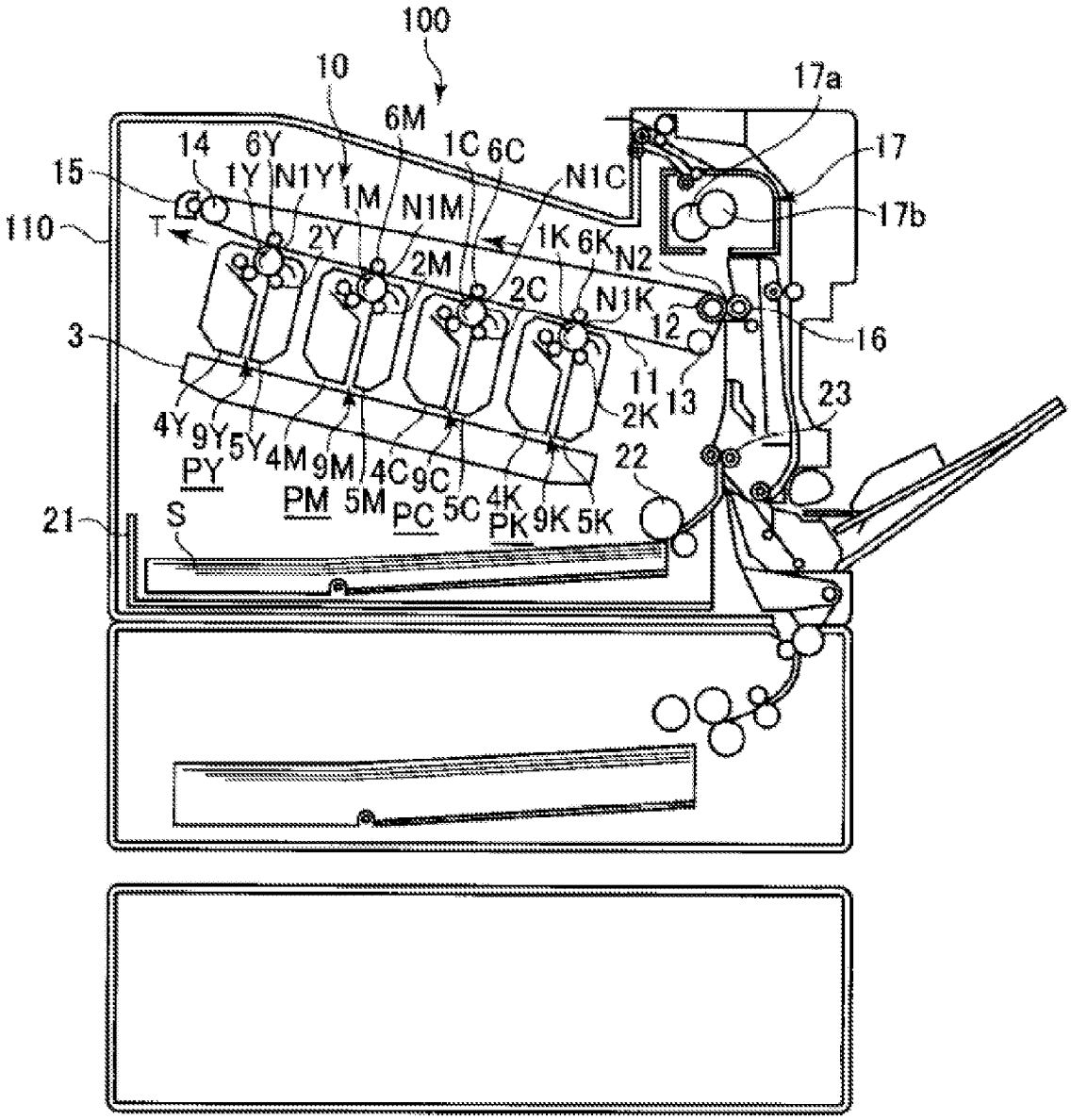
FIG. 1 is a sectional view of an image forming apparatus with respect to a vertical direction.

FIG. 1 is a sectional view of an image forming apparatus 100 according to an embodiment of the present invention with respect to a vertical direction. The image forming apparatus 100 in this embodiment is a tandem type laser beam printer which is capable of forming a full color image using an electrophotographic type and which employs an intermediary transfer type.

The image forming apparatus 100 includes, as a plurality of image forming portions, first to fourth image forming portions PY, PM, PC and PK. These four image forming portions PY, PM, PC and PK form images of yellow (Y), magenta (M), cyan (C) and black (K), respectively.

In this embodiment, constitutions and operations of the image forming portions PY, PM, PC and PK are substantially the same except that the colors of toners used are different from each other. Accordingly, in the following, in the case where particular distinction is not required, suffixes Y, M, C and K for representing elements for associated colors are omitted, and the elements will be collectively described.

The image forming apparatus 100 includes a photosensitive drum 1 which is a drum-shaped (cylindrical) electrophotographic photosensitive member as an image bearing member. The photosensitive drum 1 is rotationally driven in the clockwise direction in FIG. 1. At a periphery of the photosensitive drum 1, the following means are provided. First, a charging roller 2 which is a roller-shaped charging member as a charging means is disposed. Further, a developing device 4 as a developing means is disposed. Further, a drum cleaning device 5 as a photosensitive member cleaning means is disposed.

Further, the image forming apparatus 100 includes an exposure device (laser scanner device) 3 as an exposure means disposed so as to be capable of exposing photosensitive drums 1Y, 1M, 1C and 1K.

In addition, the image forming apparatus 100 includes an intermediary transfer belt unit 10 as a belt feeding device disposed so as to oppose the photosensitive drums 1Y, 1M, 1C and 1K. The intermediary transfer belt unit 10 is detachably mountable to an apparatus main assembly 110 of the image forming apparatus 100. The intermediary transfer belt unit 10 includes an intermediary transfer belt 11 constituted by an endless belt member as an intermediary transfer member so as to oppose the four photosensitive drums 1Y, 1M, 1C and 1K. The intermediary transfer belt 11 is stretched by, as a plurality of rollers (stretching members), a driving roller 12, a follower roller 13 and a tension roller 14. The intermediary transfer belt 11 is rotated (moved and circulated) in the counterclockwise direction in FIG. 1 by rotational drive of the driving roller 12. As specifically described later, the tension roller 14 is urged from an inner peripheral surface side toward an outer peripheral surface side of the intermediary transfer belt 11 as shown by an arrow T in FIG. 1, whereby a predetermined tension is applied to the intermediary transfer belt 11. In the inner peripheral surface side of the intermediary transfer belt 11, at positions opposing the photosensitive drums 1Y, 1M, 1C and 1K, primary transfer rollers 6Y, 6M, 6C and 6K are disposed. Each of the primary transfer rollers 6 is urged (pressed) against the intermediary transfer belt 11 toward the associated photosensitive drum 1 at predetermined pressure, so that a primary transfer portion N1 where the intermediary transfer belt 11 and the photosensitive drum 1 contact each other is formed. Further, in the outer peripheral surface side of the intermediary transfer belt 11, at a position opposing the driving roller 12, a secondary transfer roller 16 is disposed. The secondary transfer roller 16 is urged (pressed) against the intermediary transfer belt 11 toward the driving roller 12 at predetermined pressure, so that a secondary transfer portion N2 where the intermediary transfer belt 11 and the secondary transfer roller 16 contact each other is formed. Further, in the outer peripheral surface side of the intermediary transfer belt 11, at a position opposing the tension roller 14, an intermediary transfer belt cleaning device 15 as an intermediary transfer member cleaning means is disposed.

Further, in the image forming apparatus 100, a feeding and conveying device for supplying a transfer material S to the secondary transfer portion N2 and a fixing device 17 for fixing the toner image on the transfer material S, and the like are provided.

In this embodiment, the image forming portion P for forming the image of the associated one of the colors is constituted by the photosensitive drum 1, the charging roller 2, the exposure device 3 used for forming the respective color images, the developing device 4, the primary transfer roller 6, the drum cleaning device 5 and the like. Further, at each image forming portion P, a process cartridge 9 detachably mountable to the apparatus main assembly 110 of the image forming apparatus 100 is constituted by the photosensitive drum 1 and as process means actable on the photosensitive drum 1, the charging roller 2, the developing device 4 and the drum cleaning device 5.

During image formation, a surface of the photosensitive drum 1 rotating in the clockwise direction in FIG. 1 is electrically charged by the charging roller 2, and the surface of the charged photosensitive drum 1 is subjected to scanning exposure by the exposure device 3. As a result, an electrostatic latent image (electrostatic image) is formed on the photosensitive drum 1. The electrostatic latent image formed on the photosensitive drum 1 is developed as a toner image with the toner as a developer by the developing device 4. In this embodiment, the toner image is formed by a reverse development in which the toner charged to the same polarity as a charge polarity (negative in this embodiment) of the photosensitive drum 1 is deposited on an exposed portion (light portion) of the photosensitive drum 1 where an absolute value of the potential thereof is lowered by being exposed to light after being subjected to uniform charging. The toner image formed on the photosensitive drum 1 is transferred (primary-transferred) onto the intermediary transfer belt 11 rotating in the counterclockwise direction in FIG. 1 at the primary transfer portion N1 by the action of the associated primary transfer roller 6. At this time, to the primary transfer roller 6, a primary transfer voltage (primary transfer bias) which is a DC voltage of an opposite polarity (positive in this embodiment) to the charge polarity of the toner during the development is applied by a primary transfer voltage source (not shown) as a voltage applying means. For example, during full-color image formation, the toner images formed on the respective photosensitive drums 1Y, 1M, 1C and 1K are successively transferred superposedly onto the intermediary transfer belt 11.

The toner images formed on the intermediary transfer belt 11 are transferred (secondary-transferred) at the secondary transfer portion N2 by the action of the secondary transfer roller 16 onto the transfer material S such as a recording sheet fed while being sandwiched between the intermediary transfer belt 11 and the secondary transfer roller 16. At this time, to the secondary transfer roller 16, a secondary transfer voltage (secondary transfer bias) which is a DC voltage of an opposite polarity (positive in this embodiment) to the charge polarity of the toner during the development is applied from a secondary transfer voltage source (not shown) as a voltage applying means. For example, during the full-color image formation, the multiple toner images formed in a superposed state of the four color toners on the intermediary transfer belt 11 are fed by the intermediary transfer belt 11 to move to the secondary transfer portion N2, where the toner images are collectively transferred onto the transfer material S. The transfer material S is fed from a transfer material cassette 21 by a feeding roller 22, and then is fed to the secondary transfer portion N2 by a registration roller pair 23 by being timed to the toner images on the intermediary transfer belt 11.

The transfer material S on which the toner images are transferred is fed to the fixing device 17 and is heated and pressed at a fixing nip between a fixing roller 17*a* and a pressing roller 17*b* which are provided in the fixing device 17. As a result, the (unfixed) toner images on the surface of the transfer material S are fixed on the surface of the transfer material S. Thereafter, the transfer material S is discharged (outputted) to an outside of the image forming apparatus 100.

On the other hand, the toner (primary transfer residual toner) remaining on the photosensitive drum 1 after the primary transfer is removed from the photosensitive drum 1 by the drum cleaning device 5 and is collected by the drum cleaning device 5. The drum cleaning device 5 scrapes off and removes the toner from the surface of the rotating photosensitive drum 1 by a cleaning blade as a cleaning member. Further, the toner (secondary transfer residual toner) remaining on the intermediary transfer belt 11 after the secondary transfer is removed from the intermediary transfer belt 11 by the belt cleaning device 15. The belt cleaning device 15 scrapes off and removes the toner from the surface of the rotating intermediary transfer belt 11 by a cleaning blade as a cleaning member. The toner removed from the intermediary transfer belt 11 by the belt cleaning device 15 passes through a collected toner feeding path (not shown) and then is collected in a collected toner container (not shown).

2. Intermediary Transfer Belt Unit

The intermediary transfer belt unit 10 in this embodiment will be described. With respect to the image forming apparatus 100 and elements therefor, a front side in FIG. 1 is a front side, and a rear side in FIG. 1 is a rear side. A depth direction connecting the front side to the rear side is substantially parallel to the rotational axis direction of each of the rollers 12, 13 and 14 which stretch the intermediary transfer belt 11. Further, with respect to the unit 10 and elements therefor, a direction corresponding to a widthwise direction (direction substantially perpendicular to a (transfer material) feeding direction) of the intermediary transfer belt 11 is also referred to as "thrust direction".

In this embodiment, the unit 10 is detachably mountable to the apparatus main assembly 110 of the image forming apparatus 100. In this embodiment, the intermediary transfer belt 11 is detachably mountable to the unit 10 demounted from the apparatus main assembly 110, and for example, the intermediary transfer belt 11 which reached an end of a lifetime thereof can be replaced with a new intermediary transfer belt 11.

Figure 2:
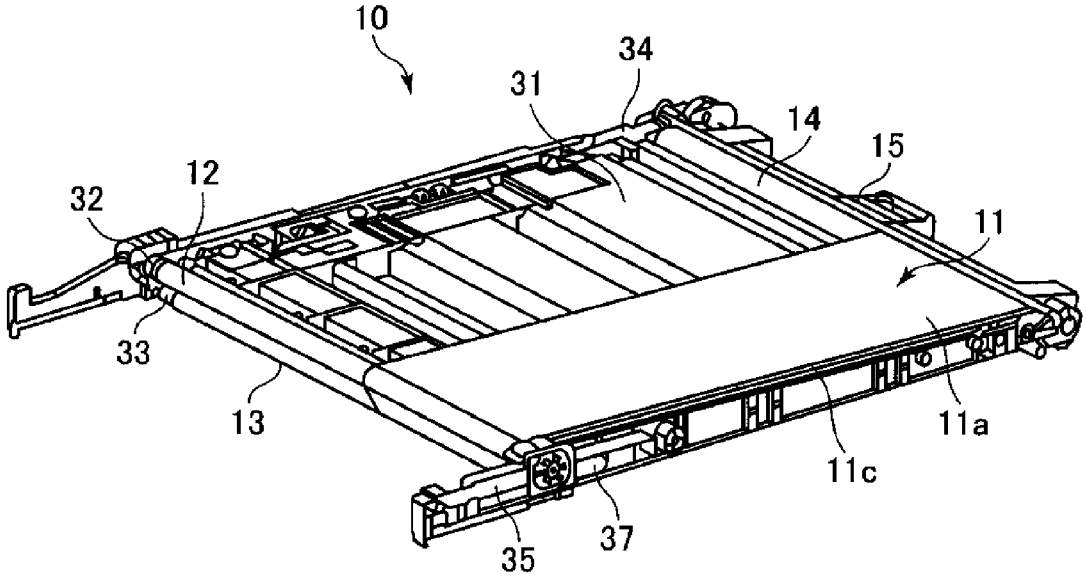
FIG. 2 is a perspective view of an intermediary transfer belt unit.

FIG. 2 is a perspective view of the unit 10. The unit 10 includes the intermediary transfer belt 11. In FIG. 2, the unit 10 is shown in a state in which a part of the intermediary transfer belt 11 is cut away. The unit 10 includes, as a plurality of rollers around which the intermediary transfer belt 11 is wound, the driving roller 12, the follower roller 13 and the tension roller 14. These driving roller 12, follower roller 13 and tension roller 14 are mounted to a frame (main frame) 31 as a supporting member.

The driving roller 12 is rotatably supported by a driving roller bearing member 32 (shown only in the front side in FIG. 2) in both end portion sides thereof with respect to a rotational axis direction (longitudinal direction) thereof. The driving roller bearing member 32 is secured to the frame 31. The driving roller 12 is rotated by a driving force transmitted from a driving means (not shown). By rotational driving of the driving roller 12, the intermediary transfer belt 11 is fed. The surface of the driving roller 12 is formed with a rubber layer having a high friction coefficient in order to feed the intermediary transfer belt 11 with no slipping.

The follower roller 13 is rotatably supported by a follower roller bearing member 33 (shown only in the front side in FIG. 2) in both end portion sides thereof with respect to a rotational axis direction (longitudinal direction) thereof. The follower roller bearing member 33 is secured to the frame 31. The follower roller 13 is rotated by rotation of the intermediary transfer belt 11.

The tension roller 14 is rotatably supported by a tension roller bearing member 34 (shown only in the front side in FIG. 2) in both end portion sides thereof with respect to a rotational axis direction (longitudinal direction) thereof. The tension roller bearing member 34 is secured to the frame 31 so as to be movable (slidable). Each of the tension roller bearing members 34 in both end portion sides of the tension roller 14 with respect to the rotational axis direction is urged by a compressive force of a tension spring 36 (FIG. 5) constituted by a compression spring as an urging means. The tension roller bearing member 34 is moved (slid) from the inner peripheral surface side toward the outer peripheral surface side of the intermediary transfer belt 11 along an urging direction by the tension spring 36. As a result, the tension roller 14 urges the intermediary transfer belt 11 from the inner peripheral surface side toward the outer peripheral surface side of the intermediary transfer belt 11, so that tension is applied to the intermediary transfer belt 11.

At the position opposing the tension roller 14, the belt cleaning device 15 is provided. Further, grip portions 35 positioned in both end portion sides of the driving roller 12 and the follower roller 13 with respect to the rotational axis direction, for use in an operation when the unit 10 is demounted from and mounted in the apparatus main assembly 110 are provided. The belt cleaning device 15 and the grip portions 35 are secured to the frame 31 so as to be detachably mountable.

In this embodiment, the frame 31 is substantially unchanged in shape between a time during feeding of the intermediary transfer belt 11 and a time during demounting of the intermediary transfer belt 11. Particularly, in this embodiment, the frame 31 is integrally formed with the associated members. The tension roller bearing members 34 in the both end portion sides of the tension roller 14, the belt cleaning device 15 and the grip portions 35 are constituted so as to be easily demounted from the frame 31.

Figure 3:
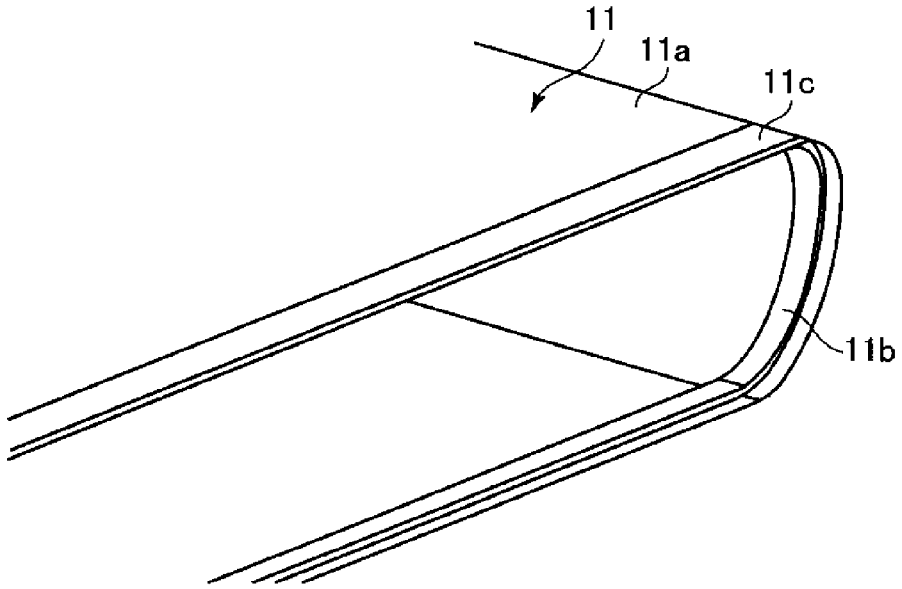
FIG. 3 is an enlarged perspective view of the intermediary transfer belt.

FIG. 3 is an enlarged perspective view of the intermediary transfer belt 11 as a belt member in this embodiment. The intermediary transfer belt 11 includes an endless belt body 11*a*. A base layer of the belt body 11*a* can be prepared by a resin-based material, having high tensile strength, such as polyimide (PI), polyvinylidene fluoride (PVDF), polyphenylene sulfide (PPS), polyether ether ketone (PEEK) or polyethylene naphthalate (PEN). In view of requirements such as ease of molding, strength and a hard-to-deform property, a thickness of the base layer is in a range of 40 μm to 100 μm in many cases. in addition, in order to enhance a transfer efficiency of the toner and the like, in some cases, a multi-layer structure obtained by bonding a different layer such as a rubber layer to the base layer over an entirety of an outer peripheral surface of the base layer may also be formed. As the belt body 11*a* of the intermediary transfer belt 11 in this embodiment, either of these structures may be used.

In each of widthwise end portions of the intermediary transfer belt 11, in the inner peripheral surface side of the belt body 11*a*, as a limiting means for limiting a change (shift) in position of the intermediary transfer belt 11 with respect to a widthwise direction of the intermediary transfer belt 11, a rib 11*b* extending in a circumferential direction of the intermediary transfer belt 11 is mounted on the belt body 11*a*. In each of the widthwise end portions of the intermediary transfer belt 11, in the outer peripheral surface side of the belt body 11*a*, a reinforcing tape 11*c* as a reinforcing means for suppressing breakage of the intermediary transfer belt 11 is mounted on the belt body 11*a*.

As the rib 11*b*, an urethane-made strip-shaped member of 3 mm in width (widthwise length of the intermediary transfer belt 11) and 1.2 mm in thickness was used. As the reinforcing tape 11*c*, a film-like adhesive tape was used. The film-like adhesive tape may be formed of any material when sufficient tensile strength is obtained. For example, as a film for the film-like adhesive tape, it is possible to use a film formed of a resin-based material such as polyester or another resin-based material such as polyimide (PI) similarly as in the base of the base layer of the belt body 11*a*. As an adhesive for the film-like adhesive tape, it is possible to use a general-purpose material such as those of an acrylic type, a silicone type and the like. The belt body 11*a* of the intermediary transfer belt 11 used in this embodiment is 792.3 mm in peripheral length of the inner peripheral surface and is 346 mm in length with respect to the widthwise direction.

3. Exchanging Procedure of Intermediary Transfer Belt (During Demounting)

An exchanging procedure of the intermediary transfer belt 11 during demounting in this embodiment will be described with reference to FIGS. 4 to 8.

Figure 4:
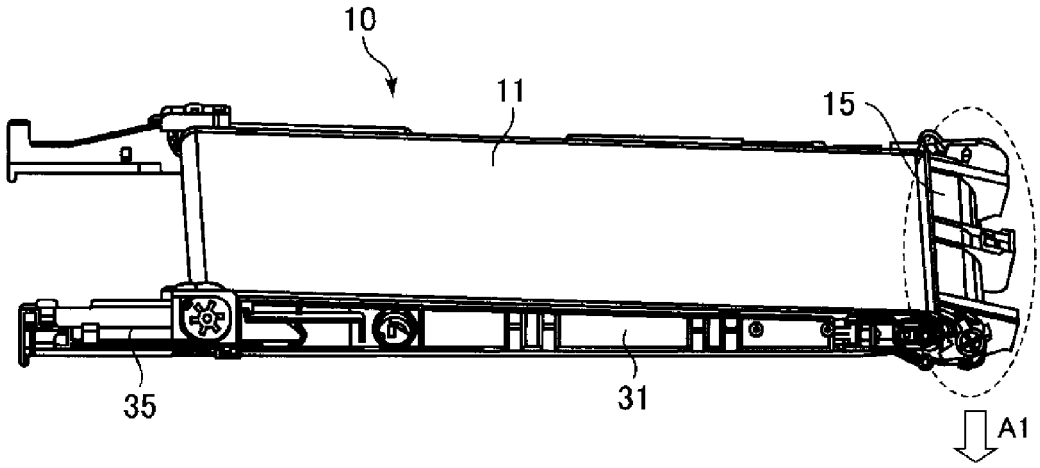
FIGS. 4 to 8 are perspective views of the intermediary transfer belt for illustrating an exchanging procedure (process) of an intermediary transfer belt.
Figure 5:
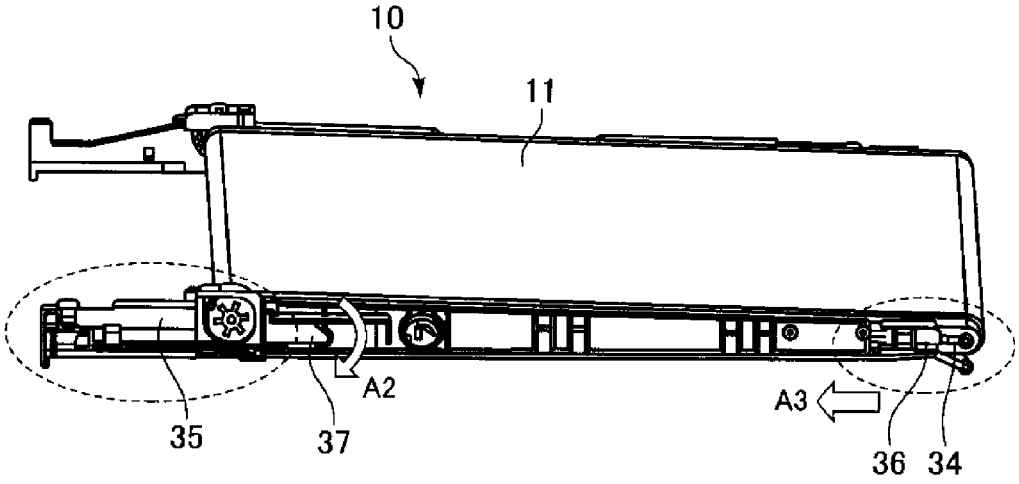

First, when the intermediary transfer belt 11 is demounted, the unit 10 is taken out from the apparatus main assembly 110, so that the unit 10 is put in a horizontally placed state in which the surface of the intermediary transfer belt 11 is developed and extended in a substantially horizontal direction between the follower roller 13 and the tension roller 14 (FIG. 4). At this time, the surface of the intermediary transfer belt 11 is directed downward. In this state, the belt cleaning device 15 is demounted from the frame 31 by disconnecting a fastening member (not shown) provided in the front side (rear side in FIG. 4) and then sliding the belt cleaning device 15 toward the rear side (front side in FIG. 4) as shown by an arrow A1 in FIG. 4 (FIG. 5).

Figure 6:
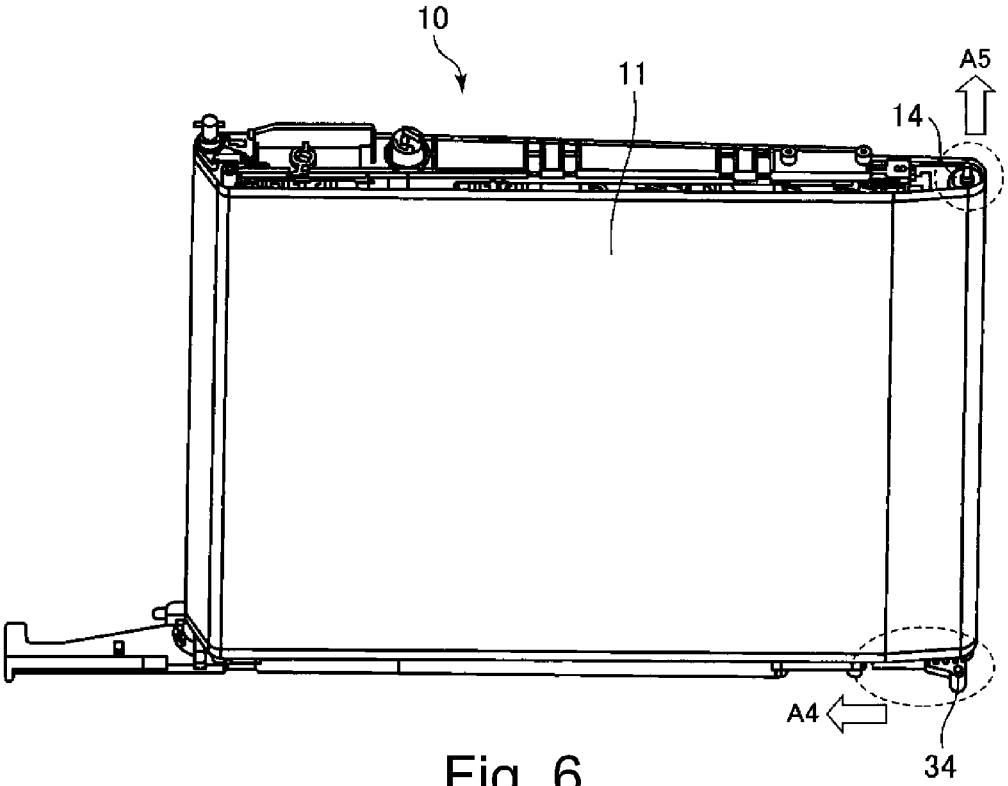

Then, the unit 10 is put in a vertically placed state in which the developed surface of the intermediary transfer belt 11 extends in a substantially vertical direction between the follower roller 13 and the tension roller 14 (FIG. 6). At this time, the front side (rear side in FIG. 5) is placed in a lower side. In this state, the grip portion 35 in the rear side (front side in FIG. 5) and the tension roller bearing member 34, which is one of the bearing members for the tension roller 14, in the rear side (front side in FIG. 5) are demounted from the frame 31. The grip portion 35 can be demounted from the frame 31 by eliminating an engagement bearing on the frame 31 and a snap fit portion 37 and then by being pulling out from the driving roller 12 after being rotated in an arrow A2 direction in FIG. 5. The tension roller bearing member 34 can be demounted from the frame 31 by being slid in an arrow A3 direction in FIG. 5 so as to compress the tension spring 36 and then by being pulling out from the tension roller 14. At this time, the tension spring 36 is demounted from the frame 31 simultaneously with the tension roller bearing member 34.

In the state shown in FIG. 6, the tension roller bearing member 34, in the front side (lower side in FIG. 6), which is the other bearing member for the tension roller 14, is slid in an arrow A4 direction in FIG. 6 so as to compress the tension spring 36. As a result, the tension of the intermediary transfer belt 11 is alleviated, and then the tension roller 14 is pulled out upward as shown by an arrow A5 in FIG. 6 and thus is demounted from the frame 31 (FIG. 7).

In this embodiment, the tension roller bearing members 34 in the both end portion sides of the tension roller 14 have substantially the same constitution, and similarly as in the case of the rear-side tension roller bearing member 34 described above, also the front-side tension roller bearing member 34 can be demounted from the frame 31. However, typically, an amount in which the front-side tension roller bearing member 34 is slid is made smaller than the amount in the case of the rear-side tension roller bearing member 34 described above to the extent that the front-side tension roller bearing member 34 is not demounted from the frame 31. As a result, the number of parts separated from the frame 31 is made small, so that the intermediary transfer belt 11 can be exchanged more easily.

Figure 7:
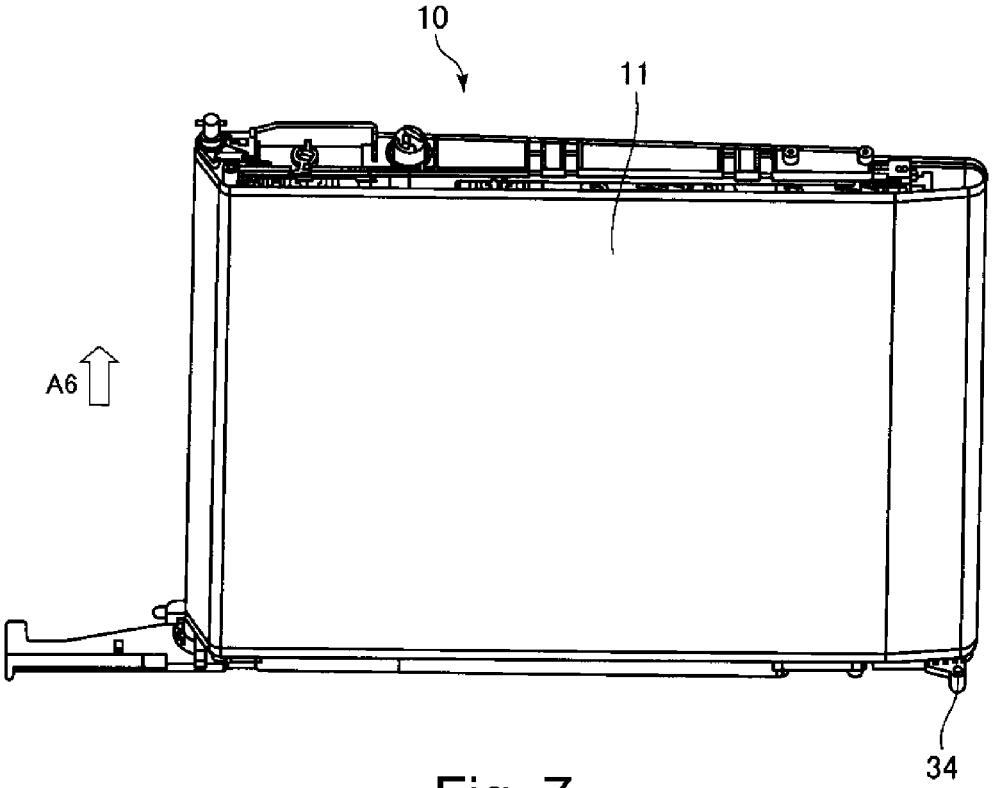
Figure 8:
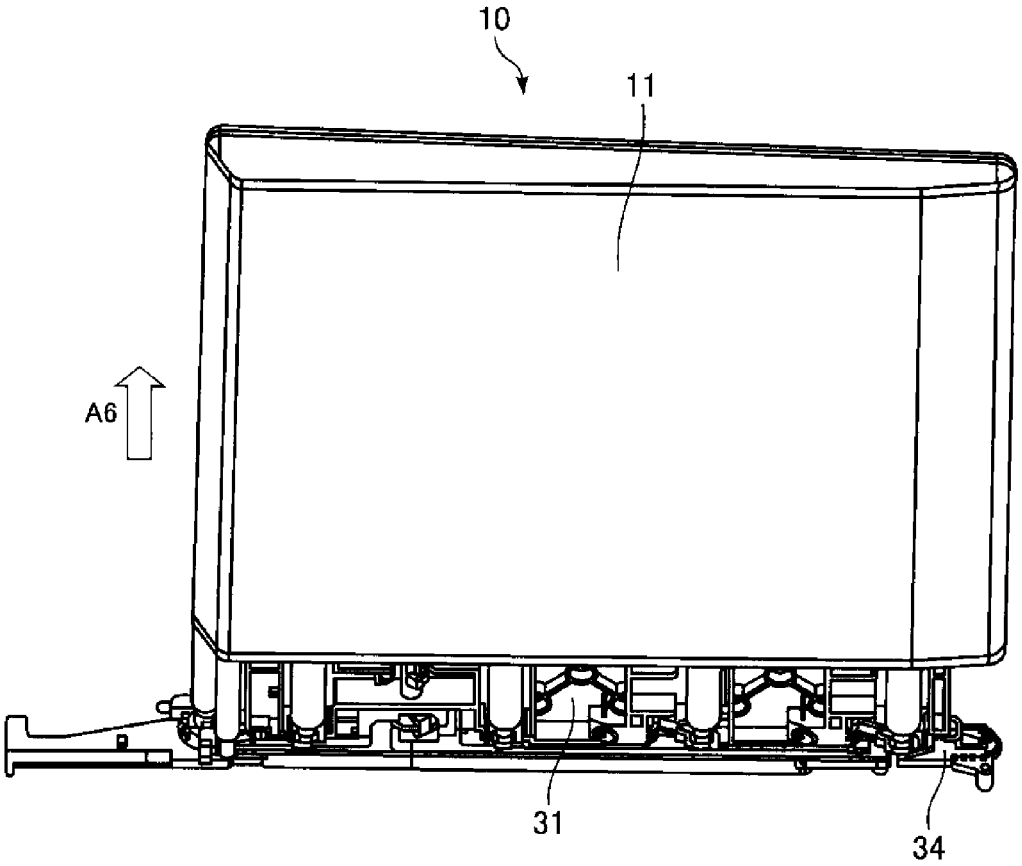

Thereafter, the intermediary transfer belt 11 is pulled out upward as shown by an arrow A6 in FIGS. 7 and 8 while being loosened using a space from which the tension roller 14 is demounted, and thus is demounted from the frame 31 (FIG. 8).

In this way, at least one of the tension roller bearing members 34 is demounted from the frame 31, and then the tension roller 14 is demounted from the frame 31. As a result, of the plurality of rollers, without demounting other rollers from the frame 31, the intermediary transfer belt 11 can be demounted from the frame 31.

4. Belt Module

A belt module 50 used for exchange of the intermediary transfer belt 11 in this embodiment will be described with reference to FIGS. 9 to 12.

The exchange of the intermediary transfer belt 11 is made by demounting the intermediary transfer belt 11 after use from the frame 31 and then by mounting a new intermediary transfer belt 11 onto the frame 31 in a procedure which is roughly reverse of the above-described procedure. In general, a replacement part for the intermediary transfer belt 11 is accommodated in a packing box. At this time, as described above, when the (new) intermediary transfer belt 11 to be replaced with the old (used) intermediary transfer belt 11 is taken out from the packing box, the intermediary transfer belt 11 is damaged or causes a dent or a fold thereon in some cases. This is particularly conspicuous in the case where the thickness of the intermediary transfer belt 11 is relatively thin as in this embodiment.

Therefore, in this embodiment, the belt module 50 used for exchange of the intermediary transfer belt 11 has the following structure. That is, the belt module 50 includes the intermediary transfer belt 11 as an endless belt member and a protecting sheet (sheet like protecting member) 51 of which a ring shape (cylindrical shape) for holding a shape of the intermediary transfer belt 11 is maintained. The protecting sheet 51 contacts the intermediary transfer belt 11 in the inner peripheral surface side of the intermediary transfer belt 11, and holds the shape of the intermediary transfer belt 11 so that the intermediary transfer belt 11 can be moved in the widthwise direction and thus can be mounted in a position surrounding the frame 31 as a supporting member. This will be specifically described below.

Figure 9:
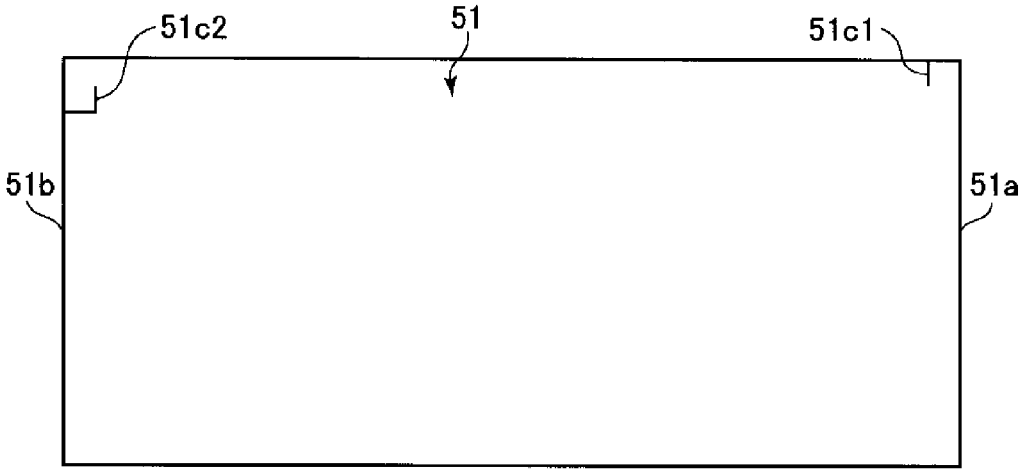
FIG. 9 is a front view of a protecting sheet in a developed state.
Figure 10:
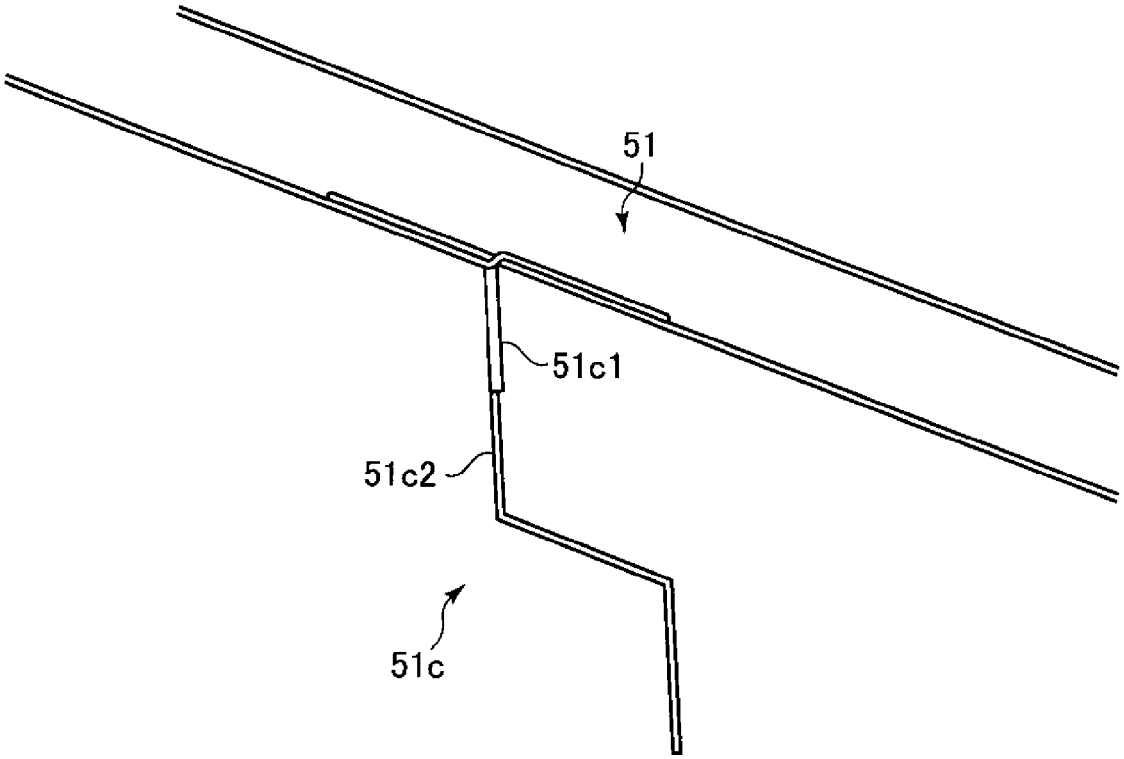
FIG. 10 is an enlarged perspective view of the protecting sheet.
Figure 11:
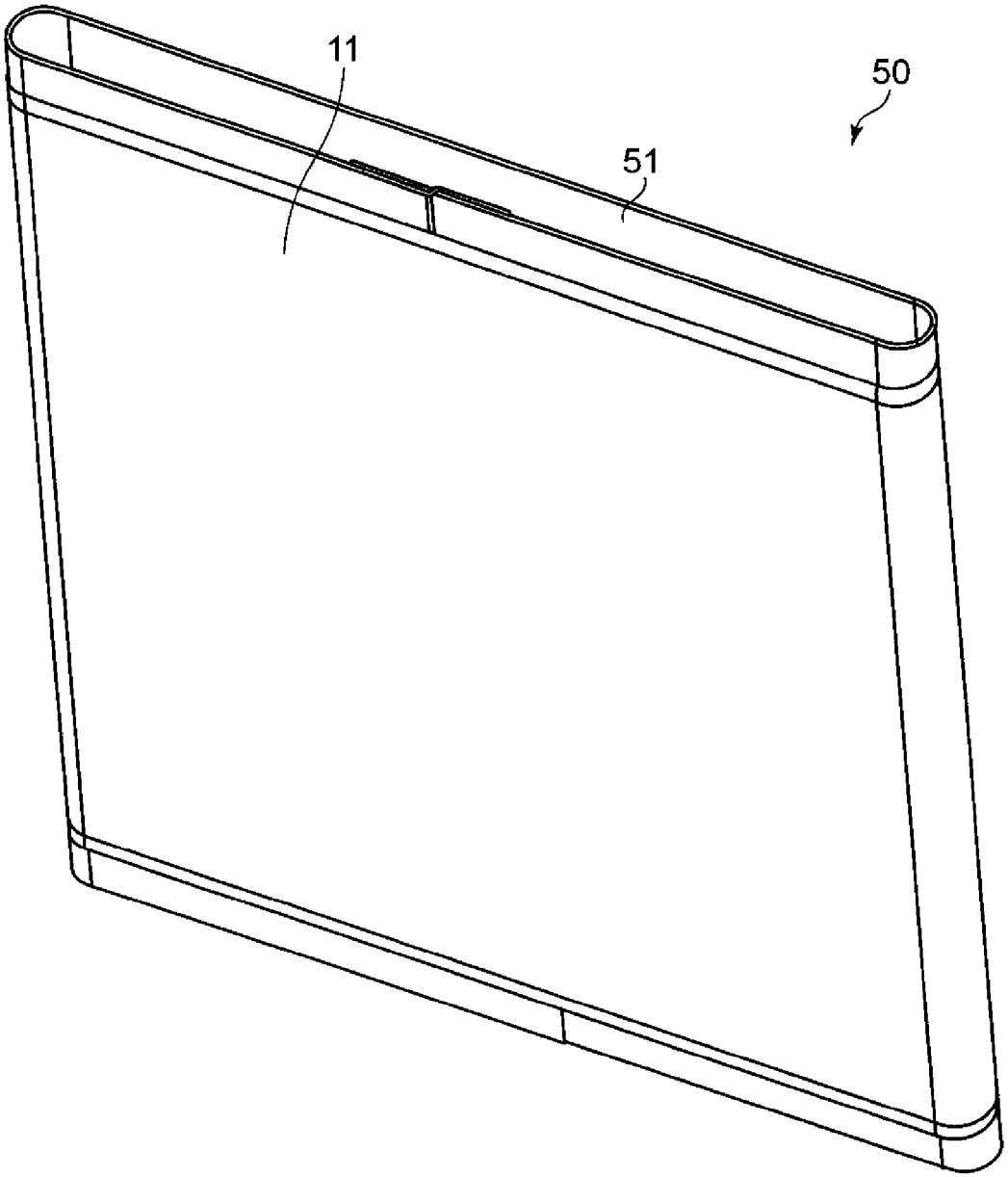
FIG. 11 is a perspective view of a belt module.
Figure 12:
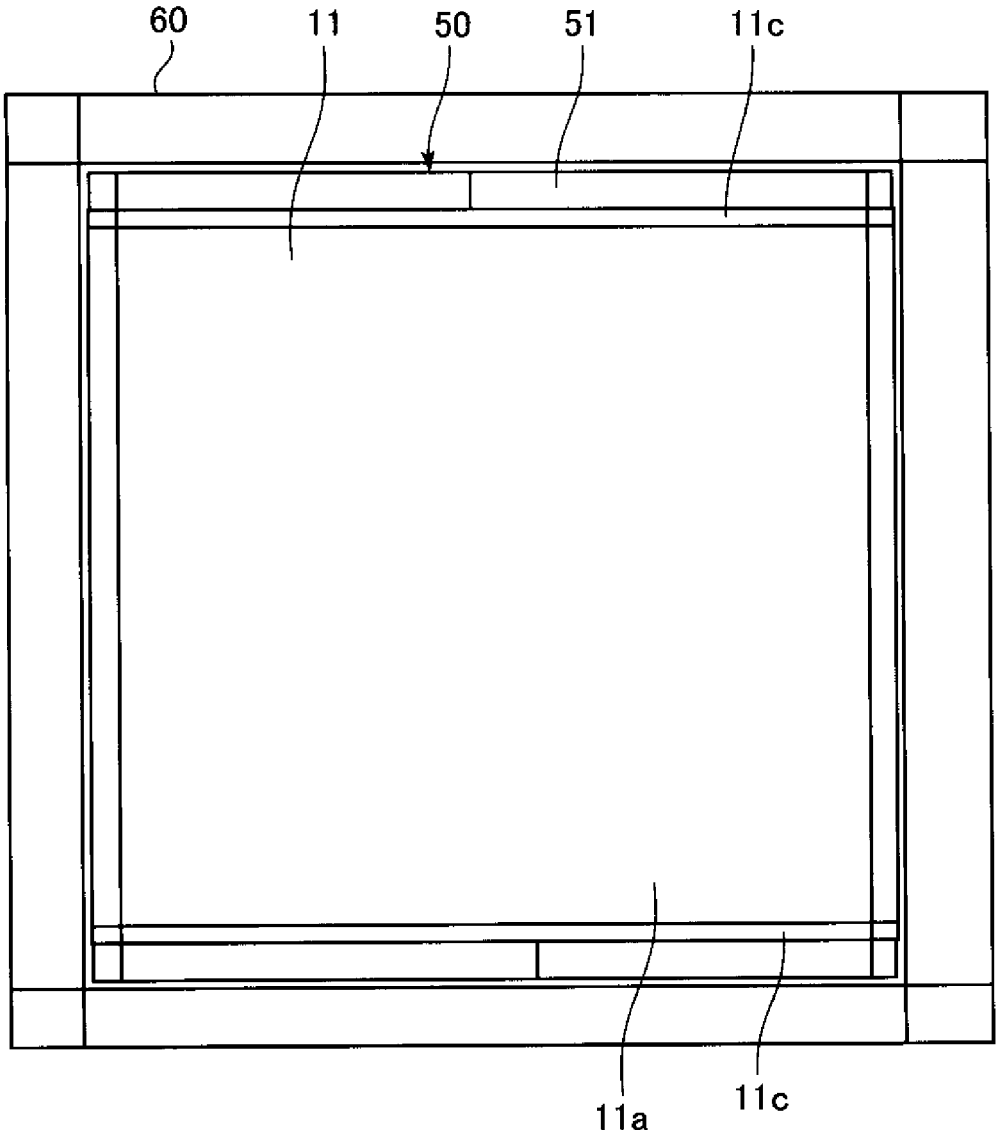
FIG. 12 is a front view of the belt module accommodated in a packing box.

FIG. 9 is a front view of the protecting sheet 51 in a state in which both end portions thereof with respect to the longitudinal direction corresponding to the circumferential direction of the intermediary transfer belt 11 are opened and developed. FIG. 10 is a perspective view showing a stopping portion described later for maintaining the protecting sheet 51 in a ring shape. FIG. 11 is a perspective view of the belt module 50. FIG. 12 is a front view showing the belt module 50 accommodated in a packing box 60.

The protecting sheet 51 can be constituted by a sheet-like member formed of an arbitrary material capable of maintaining a shape when the intermediary transfer belt 11 is mounted onto the frame 31. Typically, the protecting sheet 51 is constituted by the sheet-like member having rigidity higher than the belt body 11*a* of the intermediary transfer belt 11. In this embodiment, as the protecting sheet 51, thick paper ("GF-C157", basis weight: 157 g/m2) was used. This thick paper has a Gurley hardness of 7.25 mN (MD/long grain). Incidentally, as in this embodiment, the Gurley hardness of the belt body 11*a* of the intermediary transfer belt 11 constituted by a plastic sheet (film) of about 40 μm to 100 μm in thickness of the base material is remarkably smaller than the Gurley hardness of the protecting sheet 51 in this embodiment. However, the protecting sheet 51 is not limited to that in this embodiment, but may only be selected from those materials having proper hardness correspondingly to the intermediary transfer belt 11. A material for the protecting sheet 51 is not required to be paper, but may also be a sheet-like material capable of maintaining the shape of the intermediary transfer belt 11. For example, as the protecting sheet 51, a plastic sheet may also be used. This protecting sheet 51 suppresses deformation of the intermediary transfer belt 11 by being subjected to an external force during an exchanging operation of the intermediary transfer belt 11. Here, the protecting sheet 51 may only be required to be capable of suppressing the deformation of the intermediary transfer belt 11 to the extent that generation of damage such as a scar, a dent or a fold by the deformation of the intermediary transfer belt 11 by being subjected to the external force during mounting and demounting of the intermediary transfer belt 11. Accordingly, the intermediary transfer belt 11 may cause such a deformation that the intermediary transfer belt 11 is loosely bent as a whole to an allowable extent within such a range that a desired ring shape thereof can be maintained so that the intermediary transfer belt 11 can be mounted in a desired position surrounding the frame 31 by being moved in the widthwise direction thereof.

Further, as shown in FIG. 10, the protecting sheet 51 includes a disengageable stopping portion 51*c* for suppressing movement of both end portions of the protecting sheet 51 with respect to the longitudinal direction corresponding to the circumferential direction of the intermediary transfer belt 11 to maintain the above described ring shape. The stopping portion 51*c* may preferably be constituted by an engaged shape portion formed as a part of the protecting sheet 51 itself, such that the stopping portion 51*c* has a simple structure and is easily disengaged. Further, the stopping portion 51*c* may preferably be provided at at least one of end portions of the protecting sheet 51 with respect to a widthwise direction corresponding to a widthwise direction of the intermediary transfer belt 11, such that the stopping portion 51*c* is easily disengaged. In this embodiment, the protecting sheet 51 is provided with slits (cuts) 51*c*1, 51*c*2 at one end portion with respect to the widthwise direction of the protecting sheet 51 and at both end portions with respect to the longitudinal direction of the protecting sheet 51. When the protecting sheet 51 is formed in the ring shape, these slits 51*c*1, 51*c*2 constitute the engaged shape portion where the slits are engaged with each other, and function as the stopping portion 51*c*. This stopping portion 51*c* constrains the ring shaped protecting sheet 51 at end portions with respect to the circumferential direction (and constrains a radial direction of the ring shape), so that such a state that the protecting sheet 51 contacts the inner peripheral surface of the intermediary transfer belt 11 is maintained.

Further, in this embodiment, as described later, it is desirable that the stopping portion 51*c* is easily disengaged in a thrust direction, and therefore the stopping portion 51*c* is formed in a slidable shape by making the cuts along the thrust direction. That is, in this embodiment, the slit (first slit) 51*c*1 which is adjacent to an edge of one longitudinal end portion (first end portion) 51*a* of the protecting sheet 51 and which has a predetermined length in which the slit 51*c*1 extends from one widthwise edge of the protecting sheet 51 toward an inside of the protecting sheet 51 is formed.

Further, the slit (second slit) 51*c*2 which is adjacent to an edge of the other longitudinal end portion (second end portion) 51*b* of the protecting sheet 51 and which has a predetermined length in which the slit 51*c*1 extends from an inside position of a predetermined distance from one widthwise edge of the protecting sheet 51 toward an inside of the protecting sheet 51 is formed. The second slit 51*c*2 is further extended to an edge of the longitudinal second end portion 51*b* along the longitudinal direction of the protecting sheet 51 in order to pass the first slit 51*c*1 through the second slit 51*c*2. Then, as shown in FIG. 10, the longitudinal end portions of the protecting sheet 51 are caused to overlap with each other in a predetermined region, and the first slit 51*c*1 and the second slit 51*c*2 are engaged with each other so as to be inserted into each other, so that the protecting sheet 51 is maintained in the ring shape. In this way, the stopping portion 51*c* is constituted by the slits 51*c*1, 51*c*2 which are formed at the longitudinal end portions of the protecting sheet 51 so as to be insertable into opposing end portions in the widthwise direction of the protecting sheet 51 corresponding to the widthwise direction of the intermediary transfer belt 11. These slits 51*c*1, 51*c*2 are engaged with each other by being slid in the widthwise direction of the protecting sheet 51, and may also be not required to be formed in completely parallel to the widthwise direction if the engagement can be eliminated. The slits 51*c*1, 51*c*2 may also be inclined with respect to the widthwise direction of the protecting sheet 51 by about 30 degrees intendedly or as an allowable error.

Figure 17:
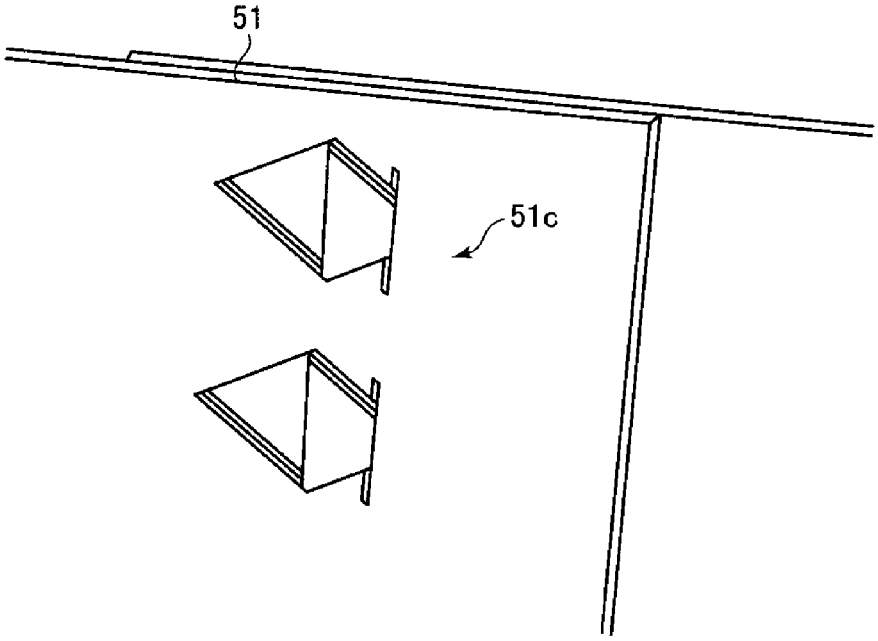
FIG. 17 is a schematic view showing an example of a stopping portion of the protecting sheet.

In this embodiment, the stopping portion 51*c* is provided in one side of the protecting sheet 51 with respect to the thrust direction of the protecting sheet 51, but may also be provided in both sides. The shape of the stopping portion 51*c* is not limited to the slit shape as in this embodiment, but may also be formed by, for example, a method, as in the case of a so called staple less stapler, in which one longitudinal end portion and the other longitudinal end portion of the protecting sheet 51 are partly folded in each other to bind (FIG. 17).

As shown in FIG. 11, the protecting sheet 51 may preferably be formed in the ring shape and mounted so as to hermetically contact the inner peripheral surface of the intermediary transfer belt 11. Specifically, in this embodiment, the rib 11*b* is provided in the inner peripheral surface side (back side) of the belt body 11*a* of the intermediary transfer belt 11, and therefore the protecting sheet 51 is secured so as to hermetically contact the protecting sheet (innermost peripheral surface of the intermediary transfer belt 11) of the rib 11*b*. Specifically, in this embodiment, a peripheral length of the inner peripheral surface of the belt body 11*a* of the intermediary transfer belt 11 is 792.3 mm and a thickness of the rib 11*b* is 1.2 mm, and therefore the protecting sheet 51 is formed to have a peripheral length of about 784.7 mm at the outer peripheral surface thereof when formed in the ring shape. That is, in this embodiment, the slits 51*c*1, 51*c*2 of the stopping portion 51*c* of the protecting sheet 51 are provided so as to form such a shape. Particularly, in this embodiment, as described above, the belt module 50 constituted by mounting the protecting sheet 51 in the inner peripheral surface side of the intermediary transfer belt 11 has an elongated circular shape or elliptical shape extending in one direction in the case where the belt module 50 is viewed in the widthwise direction of the intermediary transfer belt 11. In this embodiment, the belt module 50 can be, in the above-shaped state, disposed at a desired position surrounding the frame 31 by being moved easily in the widthwise direction of the intermediary transfer belt 11 as described later.

As shown in FIG. 12, the belt module 50 is placed in the packing box 60 in a state in which the protecting sheet 51 is secured to the intermediary transfer belt 11, and then is shipped. In this state, when the belt module 50 is subjected to impact by vibration, drop and the like, there is a possibility that the intermediary transfer belt 11 contacts the packing box 60 and thus the scar, the dent and the fold are formed at the end portions of the intermediary transfer belt 11 particularly with respect to the widthwise direction. For that reason, in this embodiment, a widthwise length of the protecting sheet 51 is longer than a widthwise length of the intermediary transfer belt 11 (specifically the belt body 11*a* of the intermediary transfer belt 11). The protecting sheet 51 is disposed so that the widthwise end portions thereof are positioned outside the widthwise end portions of the intermediary transfer belt 11, respectively. Specifically, in this embodiment, a widthwise length of the intermediary transfer belt 11 was 346 mm, whereas a widthwise length of the protecting sheet 51 was 380 mm. Accordingly, the protecting sheet 51 is in a projected state from each of the widthwise end portions of the intermediary transfer belt 11 by 17 mm with respect to the widthwise direction. As a result, before the intermediary transfer belt 11 contacts the packing box 60, the protecting sheet 51 contacts the packing box 60, so that it is possible to suppress generation of the scar, the dent and the fold on the intermediary transfer belt 11. The stopping portion 51*c* as described above is provided at the widthwise end portion of the protecting sheet 51 projected from the widthwise end portion of the intermediary transfer belt 11, so that the stopping portion 51*c* is easily disengaged without contacting the intermediary transfer belt 11.

5. Exchanging Procedure of Intermediary Transfer Belt (During Mounting)

An exchanging procedure of the intermediary transfer belt 11 during the mounting in this embodiment will be described with reference to FIGS. 13-16.

Figure 13:
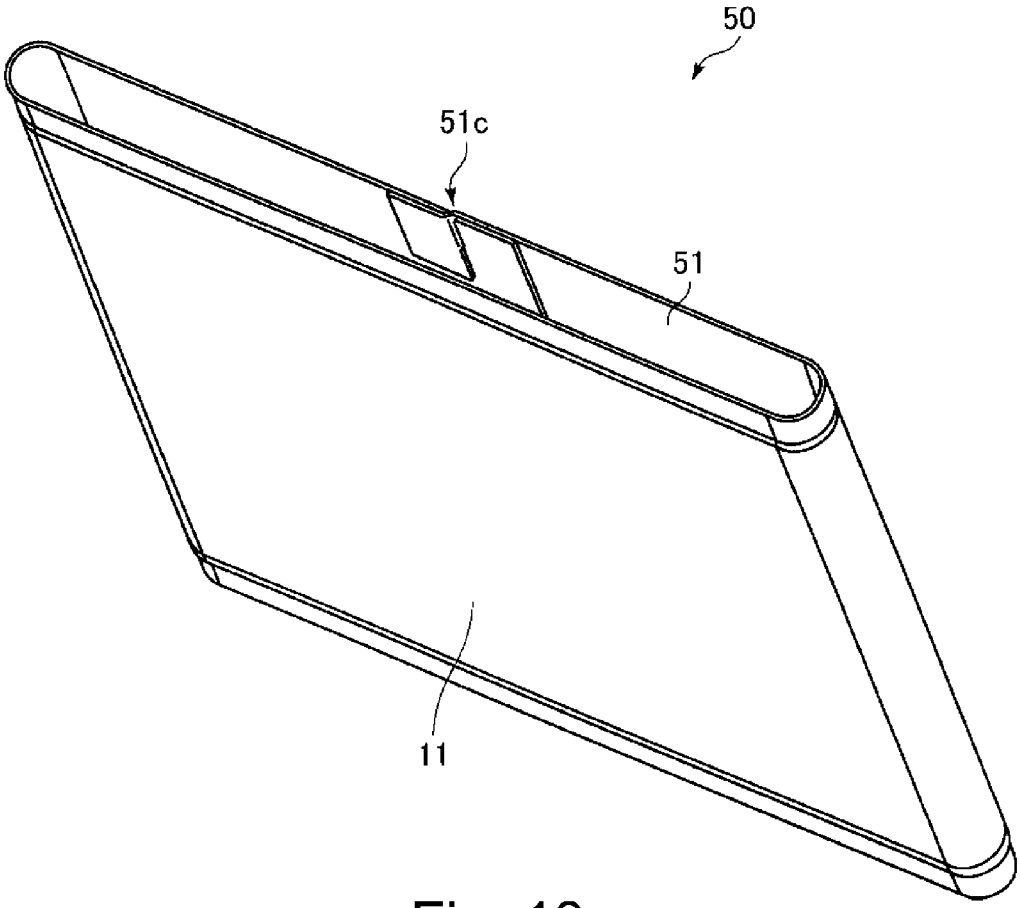
FIG. 13 is a perspective view of the belt module for illustrating the exchanging procedure of the intermediary transfer belt.

First, as shown in FIG. 8, the unit 10 is kept in the vertically placed state while keeping the old intermediary transfer belt 11 in the demounted state from the frame 31. A new intermediary transfer belt 11 is, as shown in FIG. 13, taken out from the packing box 60 so that the stopping portion 51*c* is directed upward in a state in which the protecting sheet 51 is secured to the intermediary transfer belt 11.

Figure 14:
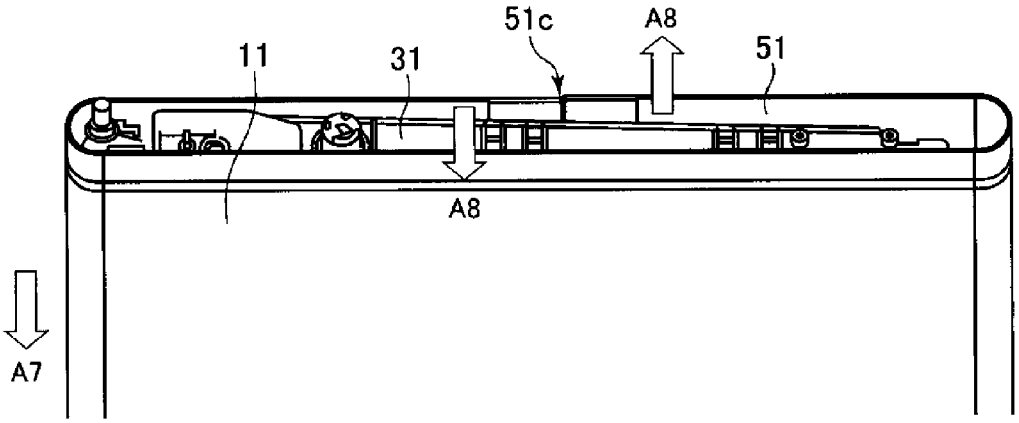
FIG. 14 is a perspective view of the intermediary transfer belt unit for illustrating the exchanging procedure of the intermediary transfer belt.

Then, as shown in FIG. 14, the intermediary transfer belt 11 to which the protecting sheet 51 is still secured is fitted around the frame 31 so as to surround the frame 31 by being moved from the rear side toward the front side of the frame 31 along the widthwise direction thereof as shown by an arrow A7 in FIG. 14.

Figure 15:
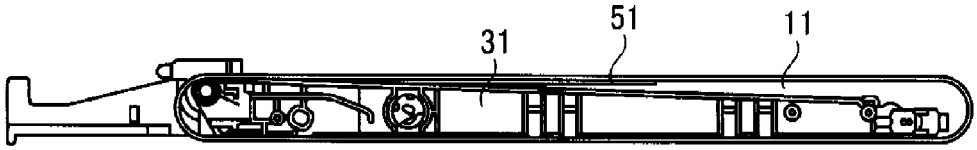
FIGS. 15 and 16 are side views of the intermediary transfer belt unit for illustrating the exchanging procedure of the intermediary transfer belt.
Figure 16:
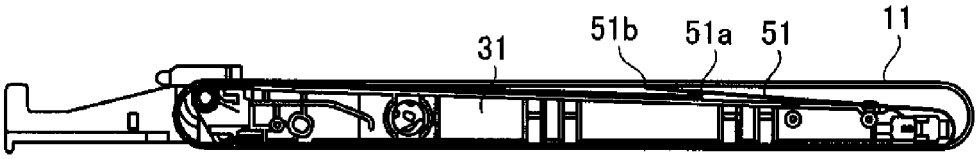

Then, the protecting sheet 51 is fitted around the frame 31 until the protecting sheet 15 abuts against the member (such as the grip portion 35) provided in the front side of the frame 31. At the abutment position, as shown by arrows A8 in FIG. 14, the slits 51*c*1, 51*c*2 of the stopping portion 51*c* are slid in opposite directions with respect to the vertical direction, so that the constraint of the protecting sheet 51 with respect to the circumferential direction (longitudinal direction) (and the constraint of the ring shape with respect to the radial direction) is eliminated. As a result, from a state in which the protecting sheet 51 hermetically contacts the intermediary transfer belt 11 as shown in FIG. 15, an outer configuration of the protecting sheet 51 can be narrowed from the outer peripheral surface side toward the inner peripheral surface side of the intermediary transfer belt 11 (i.e., in the radial direction of the ring shape) as shown in FIG. 16. Accordingly, the protecting sheet 51 can be separated from the inner peripheral surface of the intermediary transfer belt 11.

Then, in the state in which the protecting sheet 51 is narrowed as described above, the intermediary transfer belt 11 is left at the desired position surrounding the frame 31 and only the protecting sheet 51 is pulled out in an upward direction (opposite to the arrow A7 direction in FIG. 14) along the widthwise direction of the intermediary transfer belt 11. As a result, the protecting sheet 51 does not contact the intermediary transfer belt 11, so that the intermediary transfer belt 11 can be exchanged.

Thereafter, the respective parts may only be required to be mounted in a procedure which is reverse of the procedure described for the demounting of the intermediary transfer belt 11. That is, the tension roller 14 is mounted, and the tension roller bearing members 34 which have been demounted are mounted to apply tension to the intermediary transfer belt 11, and then the grip portions 35 and the belt cleaning device 15 which have been demounted are mounted.

As described above, the belt member exchanging method includes a step of disposing the belt module 50 so as to surround the frame 31, and a step of pulling out the protecting sheet 51 in the widthwise direction of the intermediary transfer belt 11 while disposing the intermediary transfer belt 11 at the position surrounding the frame 31. Preferably, in the pulling-out step, the stopping portion 51*c* of the protecting sheet 51 is disengaged to narrow the outer configuration of the protecting sheet 51 in the direction from the outer peripheral surface side toward the inner peripheral surface side of the intermediary transfer belt 11, and thereafter the protecting sheet 51 is pulled out in the widthwise direction of the intermediary transfer belt 11.

As described above, according to this embodiment, the protecting sheet 51 is mounted inside the new intermediary transfer belt 11, and when the intermediary transfer belt 11 is fitted around the frame 31, the intermediary transfer belt 11 is moved together with the protecting sheet 51. Then, after the fitting, the protecting sheet 51 is narrowed so that the inner peripheral length thereof is small, and then only the protecting sheet 51 is pulled out. As a result, the intermediary transfer belt 11 can be exchanged safely and smoothly without generating the scar, the dent and the fold on the intermediary transfer belt 11. At this time, the rigidity of the protecting sheet 51 is made higher than the rigidity of the belt body 11*a* of the intermediary transfer belt 11, so that the intermediary transfer belt 11 can be protected with high reliability. Further, the protecting sheet 51 is hermetically contacted to the inner peripheral surface of the intermediary transfer belt 11 (the rib 11*b* in this embodiment), so that the twist of the intermediary transfer belt 11 during the operation can be suppressed to a minimum and thus it is possible to suppress careless generation of the scar, the dent and the fold during the operation. Further, the widthwise length of the protecting sheet 51 is made longer than the widthwise length of the intermediary transfer belt 11, so that the widthwise end portions of the protecting sheet 51 are projected from the widthwise end portions of the intermediary transfer belt 11, respectively. As a result, the generation of the scar and the dent at the end portions of the intermediary transfer belt 11 can be suppressed with high reliability. The stopping portion 51*c* is formed by making the slits 51*c*1, 51*c*2 at the widthwise end portion of the protecting sheet 51. As a result, not only a deviation of the protecting sheet 51 in the packing box 60 can be suppressed but also the inner periphery of the protecting sheet 51 can be narrowed by easily disengaging the stopping portion 51*c*, so that the protecting sheet 51 can be easily pulled out. Therefore, according to this embodiment, even when the belt has a relatively small thickness and thus is liable to be damaged, a degree of a liability of the damage is reduced, so that the belt can be easily exchanged with good operativity.

Other Embodiments

The present invention was described above based on the specific embodiment, but is not limited to the above-described embodiment.

In the above-described embodiment, the belt member was described as the intermediary transfer belt, but is not limited thereto. For example, there is an image forming apparatus of a direct transfer type in which images formed at the plurality of image forming portions are directly transferred onto a transfer material carried and fed by a transfer material carrying member, and in some cases, as the transfer material carrying member, a transfer material feeding belt constituted by an endless belt member is used. For example, the present invention is equivalently applicable to the transfer material feeding belt in the image forming apparatus of such a direct transfer type, so that a similar effect can be obtained. The belt member may also be a photosensitive (member) belt or an electrostatic recording dielectric member belt.

In the embodiment described above, the frame as the supporting member for the belt member supports the plurality of rollers for stretching the belt member, and at least one of the rollers was in the demounted state from the frame during the demounting and mounting of the belt member relative to the frame. However, the present invention is not limited to the demounting and mounting embodiment as described above. For example, a constitution in which the shape of the frame is changed (e.g., the frame is folded in two (half)) between a time during the stretching of the belt member and a time during the demounting and mounting of the belt member, and then the belt member is moved in the widthwise direction thereof without demounting the roller from the frame and thus is demounted from and mounted on the frame in a desired position surrounding the supporting member may also be employed.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-003338 filed on Jan. 9, 2015, which is hereby incorporated by reference herein in its entirety.

What is claimed is:

1. A belt module including a replacement belt member to be supported by a supporting portion of an image forming apparatus, said belt module comprising:

an endless belt member;

an inner sheet provided along an inner peripheral surface of said belt member and configured to suppress deformation of said belt member by an external force; and a locking portion provided at each of longitudinal end portions of said inner sheet corresponding to a circumferential direction of said belt member and configured to lock the longitudinal end portions of said inner sheet so as to be disengageable from each other.

2. A belt module according to claim 1, wherein said locking portion is provided at an area outside of said belt member with respect to a widthwise direction of said belt member.

3. A belt module according to claim 1, wherein said locking portion is formed as a part of said inner sheet.

4. A belt module according to claim 1, wherein said locking portion is constituted by a slit obtained by slitting said inner sheet.

5. A belt module according to claim 1, wherein said locking portion is constituted so that the longitudinal end portions of said inner sheet are folded in to bind said inner sheet.

6. A belt module according to claim 1, wherein said locking portion is provided at one of the longitudinal end portions of said inner sheet with respect to a widthwise direction of said inner sheet and provided outside of said belt member with respect to a widthwise direction of said belt member.

7. A belt module according to claim 1, wherein a length of said inner sheet with respect to a widthwise direction corresponding to a widthwise direction of said belt member is longer than a length of said belt member with respect to the widthwise direction, and wherein said inner sheet is disposed so that widthwise end portions thereof are positioned outside widthwise end portions of said belt member with respect to the widthwise direction.

8. A belt module according to claim 1, wherein said locking portion is provided at widthwise end portions of said belt member.

9. A belt module according to claim 1, wherein rigidity of said inner sheet is higher than rigidity of said belt member.

10. A belt module according to claim 1, wherein said inner sheet is formed with paper.

11. A belt module according to claim 1, wherein said belt member is an intermediary transfer belt on which a toner image to be transferred onto a recording material is once carried or a feeding belt for carrying and feeding the recording material onto which the toner image is to be transferred.

12. A belt module including a replacement belt member to be supported by a supporting portion of an image forming apparatus, said belt module comprising:

an endless belt member; and an inner sheet provided along an inner peripheral surface of said belt member and configured to suppress deformation of said belt member by an external force, wherein said inner sheet is disposed so as to hermetically contact said belt member at a portion where an inner peripheral length of said belt member is shortest with respect to a widthwise direction of said belt member.

13. A belt module according to claim 12, wherein said belt member includes an endless belt body and a limiting portion provided on an inner peripheral surface of said belt body and extending in a circumferential direction of said belt body, wherein said inner sheet hermetically contacts said belt member at said limiting portion.

14. A belt member exchanging method using a belt module including a replacement endless belt member to be supported by a supporting portion of an image forming apparatus, an inner sheet, provided along an inner peripheral surface of the belt member, for suppressing deformation of the belt member by an external force and for protecting the inner peripheral surface of the belt member, and a locking portion, provided at each of longitudinal end portions of the inner sheet corresponding to a circumferential direction of the belt member, capable of maintaining the inner sheet in a ring shape in a state in which the longitudinal end portions are superposed on each other by being caught by each other, and capable of eliminating a stopped state during an operation for exchanging the belt member is provided, said belt member exchanging method comprising:

(a) a step of demounting the belt member from the supporting portion;

(b) a step of providing the belt module at the supporting portion in a position surrounding the supporting portion; and (c) a step of pulling-out the inner sheet from an inner peripheral surface portion of the belt member by moving the inner sheet from the belt module in a widthwise direction of the belt member in a state in which the belt member is provided in the position surrounding the supporting portion, wherein between step (b) and step (c), said belt member exchanging method further comprises a step of maintaining the inner sheet in a state in which an outer diameter of the inner sheet is smaller than the outer diameter of the inner sheet in step (b), so that a gap between the inner sheet and the belt member is increased by eliminating engagement of the locking portion.

15. A belt module including a replacement belt member to be supported by a supporting portion of an image forming apparatus, said belt module comprising:

an endless belt member;

an inner sheet, provided along an inner peripheral surface of said belt member, configured to suppress deformation of said belt member by an external force; and a fastening portion provided at each of longitudinal end portions of said inner sheet corresponding to a circumferential direction of said belt member and configured to fasten the longitudinal end portions of said inner sheet to each other, wherein said fastening portion is provided at one of the longitudinal end portions of said inner sheet with respect to a widthwise direction of said inner sheet.

16. A belt module according to claim 15, wherein said fastening portion is provided outside of said belt member with respect to a widthwise direction of said belt member.

17. A belt module including a replacement belt member to be supported by a supporting portion of an image forming apparatus, said belt module comprising:

an endless belt member; and an inner sheet, provided along an inner peripheral surface of said belt member, configured to suppress deformation of said belt member by an external force, wherein longitudinal end portions of said inner sheet corresponding to a circumferential direction of said belt member are fastened to each other at one of the longitudinal end portions of said inner sheet with respect to a widthwise direction of said inner sheet.

18. A belt module according to claim 17, wherein the longitudinal end portions of said inner sheet are fastened to each other outside of said belt member with respect to a widthwise direction of said belt member.

* * * * *